US006499525B1

(12) United States Patent
Lai

(10) Patent No.: US 6,499,525 B1
(45) Date of Patent: Dec. 31, 2002

(54) TAPE SUPPORT FOR AN AUTOMATIC WRAPPER

(76) Inventor: Chien-Fa Lai, No. 56, Industry 35 Rd., Hsi-Tun Dist., Taichung (TW)

( * ) Notice: Subject to any disclaimer, the term of this patent is extended or adjusted under 35 U.S.C. 154(b) by 1 day.

(21) Appl. No.: 09/891,375

(22) Filed: Jun. 27, 2001

(51) Int. Cl.[7] ..... B65B 13/04
(52) U.S. Cl. ..... 156/580; 100/26; 53/589
(58) Field of Search ..... 156/580; 100/26, 100/29, 32, 33 PB; 53/589

(56) References Cited

U.S. PATENT DOCUMENTS 5,651,306 A * 7/1997 Hoshino ..... 100/26
5,755,084 A * 5/1998 Dekker ..... 53/589
6,105,344 A * 8/2000 Maeda et al. ..... 53/589
6,415,712 B1 * 7/2002 Helland et al. ..... 100/26

* cited by examiner

*Primary Examiner*—James Sells
(74) *Attorney, Agent, or Firm*—Fei-Fei Chao; Venable, Baetjer, Howard & Civiletti, LLP

(57) ABSTRACT

A tape support for an automatic wrapper includes a main frame and an internal frame. The internal frame is keyed onto the main frame and has four corners. A corner block is keyed to each corner of the main frame. A guide blade assembly is pivotally keyed onto two vertical sides of the main frame, and an adjustment assembly is keyed onto two vertical sides of the main frame. The corner block has three sides. One is concave, and the others form a right angle. The guide blades face each other and wrap around the internal frame. The arms of the adjustment assembly face each other and wrap around the blade assembly. A brush is mounted on the free ends of the adjustment assembly to guide the tape to the middle by its retaining force when the tape passes through the brush.

8 Claims, 5 Drawing Sheets

TAPE SUPPORT FOR AN AUTOMATIC WRAPPER

BACKGROUND OF THE INVENTION

1. Field of the Invention

The present invention relates to a tape support, and more particularly to a tape support for an automatic wrapper. The tape support can be easily made and assembled.

2. Description of Related Art

With reference to FIGS. 4 and 5, a conventional tape support for an automatic wrapper in accordance with the prior art comprises a U-shaped main frame (60), a protective plate set (70) and a blade assembly (80). The U-shaped main frame (60) is mounted on the automatic wrapper. Four arcuate internal corners form a smooth internal edge on the frame (60). The protective plate set (70) is attached to one side of the main frame (60). The protective plate set (70) includes two main corner plates (71) which are L-shaped and three straight plates (72). the corner plates (71) are attached to the corners opposite from the automatic wrapper. The three straight plates (72) are connected to the corner plates (71) to be U-shaped and correspond to the main frame (60). The blade assembly (80) is pivotally mounted on the side of the main frame (60) opposite to the protective plates (70). The blade assembly (80) includes multiple curved blades (81) and straight blades (82). The curved blades (81) are mounted on each corner of the main frame (60) and the straight blades (82) are connected to the main curved blades (81) to form a U-shape and correspond to the main frame (60). Each of the blades (81, 82) has an L-shaped cross section. One side of the blades (81, 82) is parallel to the internal edge of the main frame (60) and the other side of the blades (81, 82) is parallel to the protective plate set (70) to form a path through which tape passes.

Each of the blades has a return spring (84) mounted thereon. The blades will open due to the pulling force of the tape when the wrapper pulls the tape. Then the tape will escape from the blades along the inclined side of the blades to wrap the object on the automatic wrapper.

The conventional tape support of an automatic wrapper as described has several disadvantages that need to be mitigated and/or obviated.

1. The structure of the conventional tape support is complicated. The conventional tape support needs many plates and blades to form the path through which tape is allowed to pass. The shapes of all the plates and blades are not the same as one another so the cost of molding and logistics is high.

2. It is hard to assembly. The plates and blades must be mounted one after one. Furthermore, each of the blades needs a pin on which the return spring is mounted. Such an assembly will waste a lot of time and money.

3. The path of the tape is not very steady during wrapping. The blades are opened from one side when the automatic wrapper pulls the tape. The tape escapes from a free end of the blades. The tape is easily inclined toward the free end of the blades because there is no adjustment assembly to adjust the tape after the tape escapes from the blades and before wrapping.

The present invention has arisen to mitigate and/or obviate the disadvantages of the conventional tape support of an automatic wrapper.

SUMMARY OF THE INVENTION

In accordance with one aspect of the present invention, a U-shaped tape support for an automatic wrapper includes a main frame and an internal frame. The internal frame is keyed on the main frame and forms four corners each having a corner block. The corners are keyed onto the corner blocks. A guide blade assembly is pivotally keyed on two vertical sides of the main frame, and an adjustment assembly is keyed on two vertical sides of the main frame. The elements of the main frame, the internal frame, the blade assembly and the adjustment assembly are made by injection molding or extruding. Each corner block has three sides, one being concave and the others forming an exterior right angle. The corner block connects the horizontal support and the vertical support of the internal frame to form a smooth internal edge. The guide blades in each assembly face each other and wraps around the internal frame. A path is formed between the internal frame and the guide blade assembly through which the tape passes. Arms of the adjustment assembly face each other and wraps around the guide blade assembly. A brush is mounted on the free end of the adjustment assembly to guide the tape to the middle by its retaining force when the tape passes through the brush.

Further benefits and advantages of the present invention will become apparent after a careful reading of the detailed description with appropriate reference to the accompanying drawings.

DETAILED DESCRIPTION OF THE INVENTION

Figure 1:
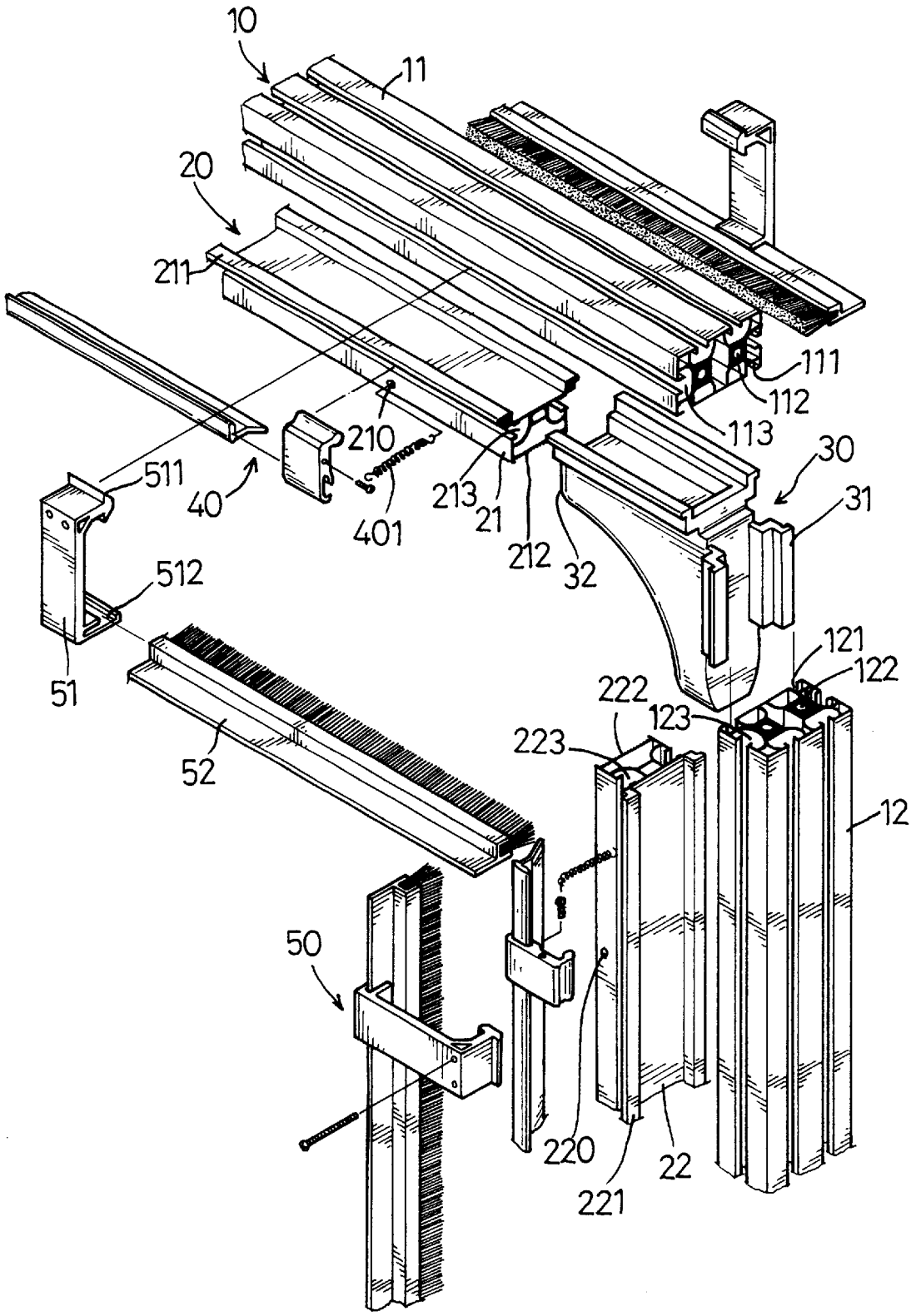
FIG. 1 is a front plan view of the tape support in accordance with the present invention mounted on an automatic wrapper.
Figure 2:
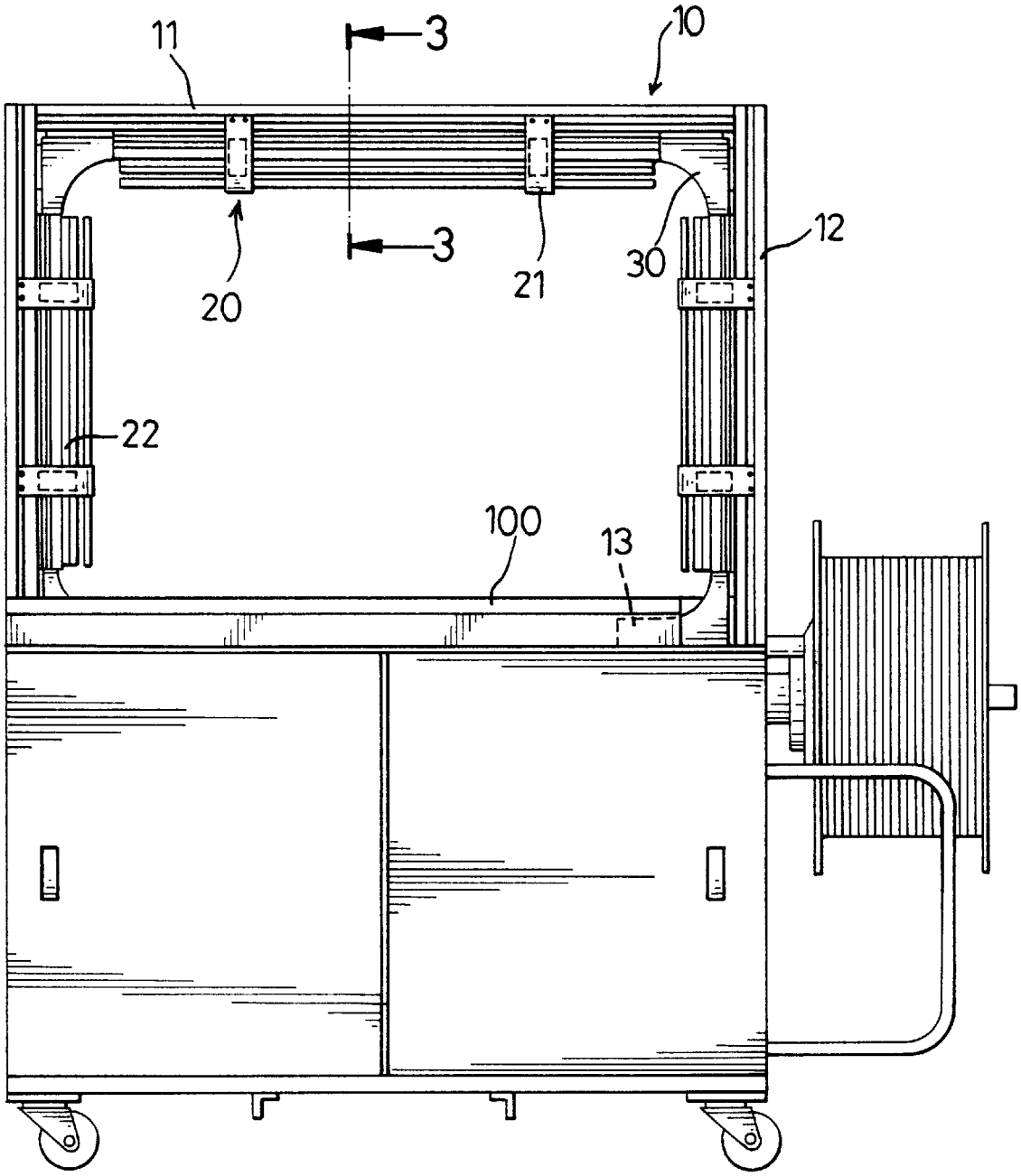
FIG. 2 is a partially exploded perspective view of a top corner of a tape support for an automatic wrapper in accordance with the present invention.
Figure 3:
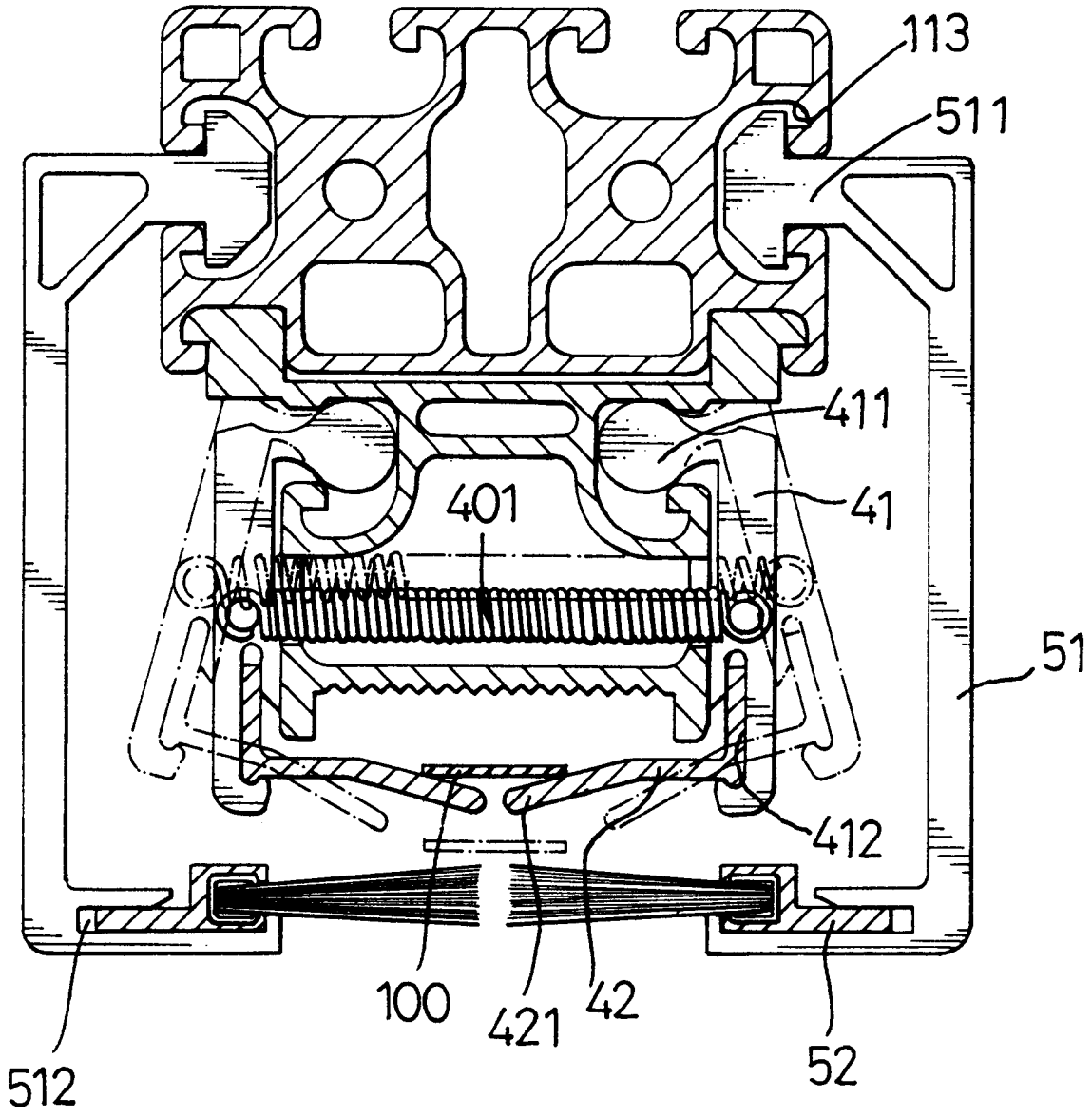
FIG. 3 is a plan view of the cross section of the tape support of an automatic wrapper along line 3—3 in FIG. 2.
Figure 4:
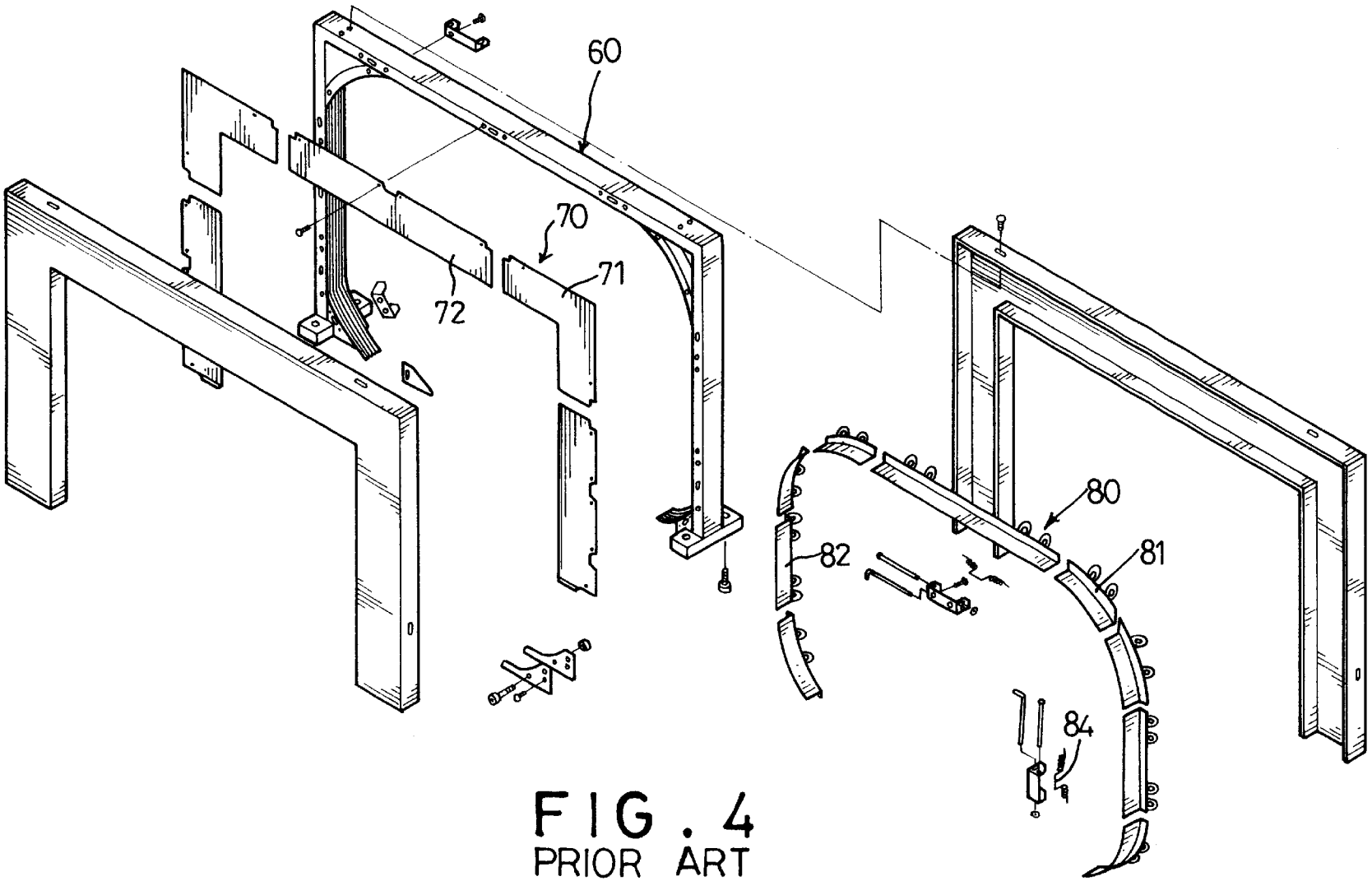
FIG. 4 PRIOR ART
FIG. 4 is an exploded perspective view of a conventional tape support for an automatic wrapper in accordance with the prior art.
Figure 5:
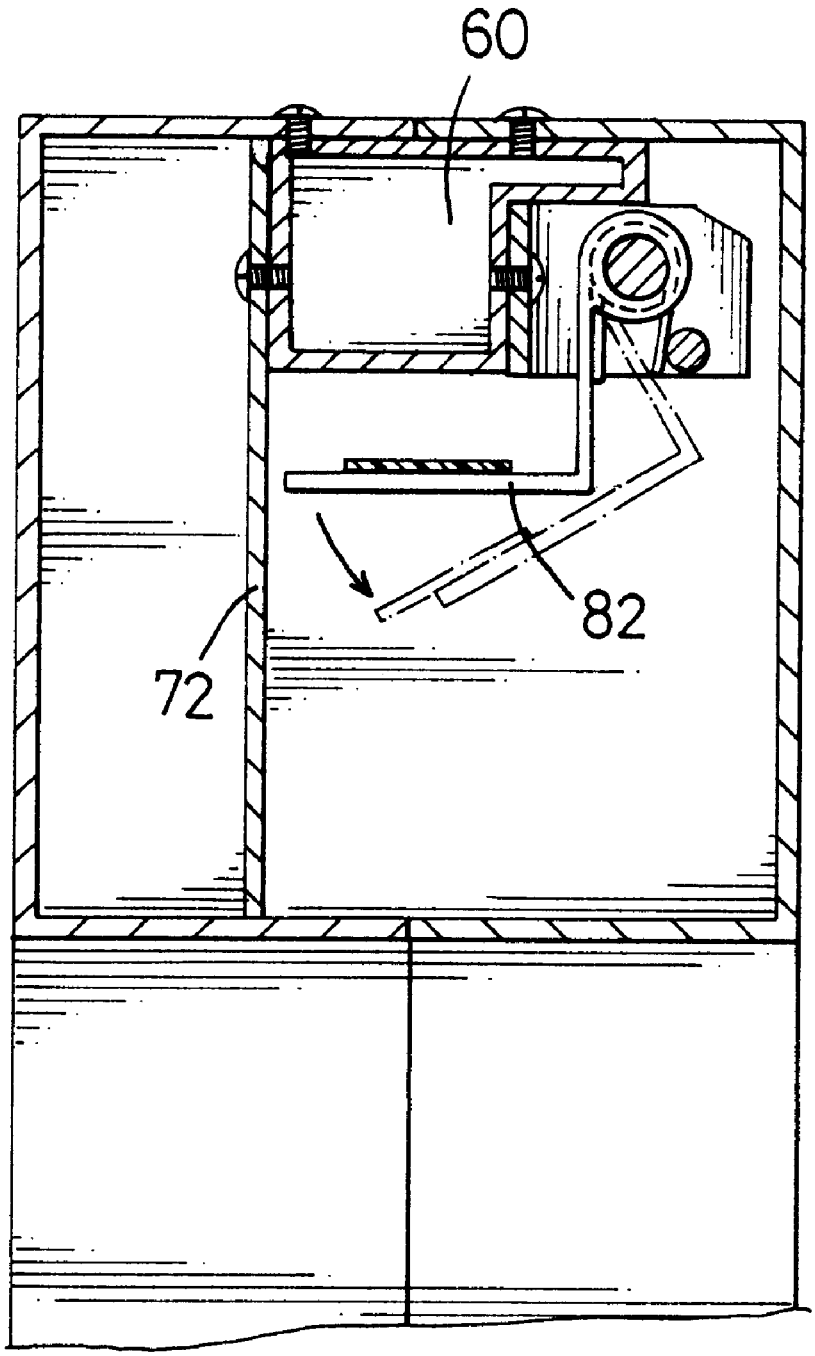
FIG. 5 PRIOR ART
FIG. 5 is an enlarged side plan view in partial section through a spring-blade assembly of the tape support in FIG. 4.

With reference to the drawings and initially to FIGS. 1–3, a tape support for an automatic wrapper in accordance with the present invention is U-shaped and comprises a main frame (10), an internal frame (20), four corner blocks (30), three blade assemblies (40) and three adjustment assemblies (50). The main frame (10) is mounted on the automatic wrapper, forms four corners, has a top and a bottom and has an inside edge and an outside edge. The internal frame (20) is keyed on the inside edge of the main frame (10). A corner block (30) is mounted at each corner of the main frame (10), and the two corner blocks (30) at the bottom of the main frame (10) connect to the automatic wrapper. The corner blocks (30) and the internal frame (20) form an inverted U-shape corresponding to the main frame (10). The blade assemblies (40) are pivotally mounted on two opposite sides of the internal frame (20) and wrap around the internal frame (20). Each adjustment assembly (50) is mounted on a different side of the main frame (10) and wraps around the internal frame (20) and the blade assembly (40).

The main frame (10) includes a main horizontal support (11) with two ends. Each end of the main horizontal support (11) abuts a main vertical support (12). The main vertical support (12) includes a free end, and a connector (13) is attached to the free end of the main vertical support (12). The connector (13) is parallel to the main horizontal support (11) and mounted on the automatic wrapper. The two connectors (13) extend toward each other. The main horizontal support (11), the main vertical support (12) and the connector (13) are made by injection molding or extrusion. The main horizontal support (11) includes a horizontal side facing the automatic wrapper. At least one interior keyway (111) is formed in the horizontal side facing the automatic wrapper. With reference to FIG. 1, two main keyways (111) are parallel to the main horizontal support (11). A main through hole (112) is defined above and parallel to each main keyway (111 ). Two main through holes (112) are shown in FIG. 1. Each main through hole (112) has two ends. Each end is threaded. The main horizontal support (11) includes two vertical sides. a secondary keyway (113) is defined in each vertical side parallel to the main horizontal support (11). The two secondary keyways (113) are aligned with each other on opposite sides of the main horizontal support (11).

The main vertical support (12) and the connector (13) are the same structural configuration as the main horizontal support (11). Each including a main keyway (121), main through hole (122) and secondary keyway (123). The main keyway (121) of the main vertical support (12) vertically communicates with the main keyway (111) of the main horizontal support (11), and the main keyway (131) of the connector (13) vertically communicates with the main keyway (121) of the main vertical support (12).

The internal frame (20) includes an internal horizontal support (21) and two internal vertical supports (22). At least one frame key (211) extends from the edge of the internal horizontal support (21) facing the main horizontal support (11). The frame key (211) corresponds to the main keyway (111) and is received in the main keyway (111). A guide (212) is formed on the internal face of the internal horizontal support (21) opposite to the main horizontal support (11). The internal horizontal support (21) has two ends and has two vertical sides. Each end abuts a corner block (30), and at least two second through holes (210) are defined in each vertical side. A guide keyway (213) is defined in each of the two vertical sides of the internal horizontal support (21). These two guide keyways (213) are symmetric with each other and parallel to the internal horizontal support (21). The configuration of the internal vertical support (22) is the same as the internal horizontal support (21) and has at least two through holes (220), a frame key (221), guide (212) and two guide keyways (223).

An exterior right-angle is formed on the corner block (30). Connector keys (31) are formed on and extend from the adjacent right-angle sides of the corner block (30) and correspond to the main keyways (111, 121). The two adjacent sides each have a length corresponding to each other. One of the two connector keys (31) is receive in the main keyway (111) of the main horizontal support (11) and the other is received in the main keyway (121) of the main vertical support (12). The corner blocks (30) connect the main vertical supports (12) to the main horizontal support (11) and the connector (13) to form a U-shape. A strike plate (32) is formed at each distal end of the corner block (30) to respectively abut the main vertical support (12) and the main horizontal support (11) or the connector (13) as appropriate.

As described above, the length of the internal horizontal support (21) of the internal frame (20) and the twice length of the connector key (31) of the corner block (30) make the length of the main horizontal support (11) of the main frame (10). The length of the internal vertical support (22) of the internal frame (20) and the twice length of the connector key (31) of the corner block (30) make the length of the main vertical support (12) of the main frame (10). The length of the connector (13) is equal to the length of the connector key (31) of the corner block (30).

With reference to FIGS. 2 and 3, one of the three blade assemblies (40) is mounted on the internal horizontal support (21) and the other two are respectively mounted on the two internal vertical supports (22). For example, the blade assembly (40) mounted on the internal horizontal support (211) includes multiple main connecting blocks (41) mounted in pairs with main connecting blocks (41) in each pair mounted on opposite sides of the internal horizontal support (21) of the internal frame (20). In the preferred embodiment of the present invention, each of the opposite sides has two main connecting blocks (41) mounted on the internal horizontal support (21) corresponding to the second through hole (210) of the internal horizontal support (21). The main connecting block (41) is L-shaped and has a first side and a second side. A guide key (411) is formed on the first side of the main connecting block (41) to be pivotally received in the guide keyway (213) in the internal horizontal support (21). The main connecting block (41) includes a guide blade keyway (412) longitudinally defined in the second side. An L-shaped guide blade (42) has a short side received in the guide blade keyway (412) and a long side extending below the internal horizontal support (21) to form a passage through which a tape (100) passes. The free end of the long side of the guide blade (42) bends slightly away from the internal horizontal support (21) to form a guiding portion (421) near the central line of the internal frame (20). A spring (401) extends through the second through holes (210) and has two ends respectively secured to two opposite main connecting blocks (41).

One of the three adjustment assemblies (50) is mounted on the main horizontal support (11) and the other two are respectively mounted on the two main vertical supports (12) of the main frame (10). For example, the adjustment assembly (50) mounted on the main horizontal support (10) includes multiple brackets (51) with at least one bracket (51) secured on each side of the main horizontal support (11) of the main frame (10). In the preferred embodiment of the present invention, two brackets (51) are mounted on each side of the main horizontal support (11). The bracket (51) is U-shape. The bracket (51) has a main arm forming a bracket key (511) securely received in the secondary keyway (113) of the main horizontal support (11) and a second arm extending below the guide blade (42) of the blade assembly (40). A brush keyway (512) is laterally defined in the second arm of the bracket (51). A long brush (52) is mounted in the bracket (51). The brush (52) includes a ferrule (521) partially received in the brush keyway (512) and bristles (522) extending to the central line of the main frame (10) below and parallel to the guide blades (42).

The steps to assemble the tape support for an automatic wrapper follow.

1. The two connectors (13) of the main frame (10) are secured on the working surface of the automatic wrapper corresponding to the length of the main horizontal support (11) of the main rod (10). One of the connector keys (31) of the corner block (30) is inserted into each of the main keyways of the connector (13), and the other is positioned flush with the external end of the connector (13).

2. Each of the two main vertical supports (12) is vertically keyed onto a corresponding one of the corner blocks (30) by receiving the connector key (31) of the corner (30) in the main keyway (121) of the main vertical support (12). Two through holes are defined in the main vertical support (12) and aligns with the through hole. A bolt (not shown) extends through the through hole in the main vertical support (12) and is screwed into the threaded portion of the through hole in the connector (13) to securely hold the main vertical support (12) in place.

3. The two internal vertical supports (22) are respectively keyed onto opposite main vertical supports (12) of the main frame (10). The internal vertical supports (22) face each other because the connector key (31) of the corner block (30) is arranged to be received in the main keyway (121) of the main vertical support (12). The guide blade assembly (40) and the adjustment assembly (50) are respectively mounted in the guide keyway (223) of the interior vertical support (22) and the secondary keyway (123) of the main vertical support (12).

4. The frame key (211) of the interior horizontal support (21) is inserted into the main keyway (111) of the main horizontal support (11) to mount the internal horizontal support (21) on the main horizontal support (11). The guide blade assembly (40) and the adjustment assembly (50) are respectively keyed into the guide keyway (213) in the internal horizontal support (21) and the second keyway (113) in the main horizontal support (11). Two corner blocks (30) are respectively keyed onto two opposite ends of the main horizontal support (11). One of the connector key (31) is received in the main keyway (111) of the main horizontal support (11) and the other corresponds to the main keyway (121) of the main vertical support (12).

5. The tape support of the present invention is finished when the connector key (31) of the corner block (30) assembled in step 4 is keyed to the main keyway (121) of the main vertical support (12). Two through holes are horizontally defined in the main vertical support (12) and correspond to the main through hole (112) in the main horizontal support (11). A bolt (not shown) extends through the through hole of the main vertical support (12) and is screwed into the threaded portion of the main through hole (112) of the main horizontal support (11) to securely hold the main horizontal support (11) in place.

As described above, the tape support of an automatic wrapper in accordance with present invention has the following advantages.

1. The structure of the present invention is simple and almost all of the elements are made by injection molding or extrusion so that the cost and time of manufacturing are reduced.

2. The main components of the present invention are assembled by keys and keyways. Assembly the tape support is so simple that skilled workers are not required to assemble the tape support.

3. The tape support of the present invention can be easily escaped from a working surface of the automatic wrapper to reduce the volume of the automatic wrapper when it is transported or stored.

4. The adjustment assembly prevents the tape from swinging after the tape escapes from the guide blade assembly due to the restitution force of the brush and promotes the preciseness of wrapping.

Although the invention has been explained in relation to its preferred embodiment, it is to be understood that many other possible modifications and variations can be made without departing from the spirit and scope of the invention as hereinafter claimed.

What is claimed is:

1. A tape support of an automatic wrapper comprising:

a main frame adapted to be mounted on the automatic wrapper, the main frame including a main horizontal support and two main vertical supports each having a main end attached to two opposite ends of the main horizontal support and a second end, and a connector attached to the second end of the main vertical support, the two connectors being parallel to the main horizontal support and directing to each other, the main horizontal support, the main vertical support and the connector each having a main keyway axially defined in an internal side, the main horizontal support and the main vertical support each having two second keyways respectively axially defined in two opposite sides of the main horizontal support and the main vertical support;

an internal frame keyed onto the main frame, the internal frame including an internal horizontal support having at least one ear extending to be received in the main keyway of the main horizontal support of the main frame and one side forming a guide opposite to the main horizontal support, the internal horizontal support including two opposite sides vertical to the main horizontal support each having a guide keyway axially defined parallel to each other and multiple through holes defined in the two opposite sides of the internal horizontal support, the internal frame including two internal vertical supports being the same as the internal horizontal support and respectively keyed onto the two main vertical supports of the main frame;

four corner blocks each mounted in a corresponding one of the four corners of the main frame, the corner block being a right angle and including two adjacent sides each having a connector key extending to be received in the main keyways of the main vertical support and the main horizontal support and the connector, respectively; and three guide blade assemblies each including:

multiple main connecting blocks respectively pivotally mounted on the guide keyway of the two opposite sides of the internal horizontal support and internal vertical supports and corresponding to the through holes in the internal horizontal support and internal vertical supports, the main connecting block being L-shaped and having a first side forming a guide key pivotally received in the guide keyway of the internal horizontal support and internal vertical support and a second side;

a guide blade keyway longitudinally defined in the second side of the main connecting block;

an L-shaped guide blade having a first side received in the guide blade keyway of the main connecting block and a second side extending parallel to the guide of the internal horizontal support and internal vertical supports to form a passage through which a tape passes, the second side of the L-shaped guide blade having a free end extending outwardly relative to the guide of the internal horizontal support and internal vertical supports to form a guiding portion near a central line of the internal frame; and a spring extending through the through holes of the internal horizontal support and internal vertical supports and having two ends respectively secured on two opposite main connecting blocks.

2. The tape support of an automatic wrapper as claimed in claim 1, wherein the main horizontal support of the main frame comprises at least one through hole axially defined in the main horizontal support, the through hole of the main horizontal support having two opposite ends that are threaded.

3. The tape support for an automatic wrapper as claimed in claim 1, wherein the two adjacent sides of the corner block each has a length corresponding to each other.

4. The tape support of an automatic wrapper as claimed in claim 2, wherein the two adjacent sides of the corner block each has a length corresponding to each other.

5. The tape support for an automatic wrapper as claimed claim 1 further comprising three adjustment assemblies respectively mounted on the main horizontal support and the two main vertical supports of the main frame, the adjustment assembly including:

multiple brackets mounted on the second keyway on the two opposite sides of the main horizontal support and two main vertical supports, the bracket being U-shaped and having a main arm with a bracket key securely received in the secondary keyway of the main horizontal support and two main vertical supports and a second arm extending below the guide blade of the guide blade assembly;

a brush keyway laterally defined in the second arm of the bracket; and a brush mounted in the bracket, the brush having a ferrule partially received in the brush keyway and bristles extending to the central line of the main frame below and parallel the guide blade.

6. The tape support for an automatic wrapper as claimed claim 2 further comprising three adjustment assemblies respectively mounted on the main horizontal support and the two main vertical supports of the main frame, the adjustment assembly including:

multiple brackets mounted on the second keyway on the two opposite sides of the main horizontal support and two main vertical supports, the bracket being U-shaped and having a main arm with a bracket key securely received in the secondary keyway of the main horizontal support and two main vertical supports and a second arm extending below the guide blade of the blade assembly;

a brush keyway laterally defined in the second arm of the bracket; and a brush mounted in the bracket, the brush having a ferrule partially received in the brush keyway and bristles extending to the central line of the main frame below and parallel the guide blade.

7. The tape support for an automatic wrapper as claimed claim 3 further comprising three adjustment assemblies respectively mounted on the main horizontal support and the two main vertical supports of the main frame, the adjustment assembly including:

multiple brackets mounted in the secondary keyway of the two opposite sides of the main horizontal support and two main vertical supports, the bracket being U-shaped and having a main arm with a bracket key securely received in the secondary keyway of the main horizontal support and two main vertical supports and a second arm extending below the guide blade of the blade assembly;

a brush keyway laterally defined in the second arm of the bracket; and a brush mounted in the bracket, the brush having a ferrule partially received in the brush keyway and bristles extending to the central line of the main frame below and parallel the guide blade.

8. The tape support for an automatic wrapper as claimed claim 4 further comprising three adjustment assemblies respectively mounted on the main horizontal support and the two main vertical supports of the main frame, the adjustment assembly including:

multiple brackets mounted in the secondary keyway of the two opposite sides of the main horizontal support and two main vertical supports, the bracket being U-shaped and having a main arm with a bracket key securely received in the secondary keyway of the main horizontal support and two main vertical supports and a second arm extending below the guide blade of the blade assembly;

a brush keyway laterally defined in the second arm of the bracket; and a brush mounted in the bracket, the brush having a ferrule partially received in the brush keyway and bristles extending to the central line of the main frame below and parallel the guide blade.

* * * * *